US005350118A

United States Patent [19]

Mitchell et al.

[11] Patent Number: 5,350,118

[45] Date of Patent: Sep. 27, 1994

[54] GLASS CULLET SEPARATOR AND METHOD OF USING SAME

[75] Inventors: James T. Mitchell; James L. Mitchell, both of Eugene, Oreg.; Mark A. Woods, Renton, Wash.

[73] Assignee: Alpine Technology, Inc., Eugene, Oreg.

[21] Appl. No.: 101,271

[22] Filed: Aug. 2, 1993

Related U.S. Application Data

[63] Continuation of Ser. No. 798,166, Nov. 26, 1991, abandoned.

[51] Int. Cl.[5] ..... B05B 12/02

[52] U.S. Cl. ..... 239/551; 239/562; 239/566; 239/590; 239/DIG. 21; 209/588; 209/577; 209/644

[58] Field of Search ..... 239/550, 551, 562, 566, 239/590, 591, 600, DIG. 21, DIG. 22; 209/516, 577, 580, 587, 588, 638, 614, 657

[56] References Cited

U.S. PATENT DOCUMENTS

| | | | |
|---|---|---|---|
| 2,343,958 | 3/1944 | Crowe | 239/591 |
| 2,481,961 | 9/1949 | Ward, Jr. | 239/566 |
| 2,827,112 | 3/1958 | Inskeep | 239/566 |
| 3,403,862 | 10/1968 | Dworjanyn | 239/566 |
| 3,489,277 | 1/1970 | Silverman | 209/587 |
| 3,756,404 | 9/1973 | King et al. | 209/588 |
| 3,802,558 | 4/1974 | Rhys | 209/588 |
| 3,880,289 | 4/1975 | Gray | 209/588 |
| 3,901,388 | 8/1975 | Kelly | 209/587 |
| 4,373,638 | 2/1983 | Schapper | 209/587 |
| 4,513,868 | 4/1985 | Culling et al. | 209/587 |
| 4,699,273 | 10/1987 | Suggi-Liverani et al. | 209/587 |
| 5,170,943 | 12/1992 | Artzberger | 239/DIG. 21 |

FOREIGN PATENT DOCUMENTS

| | | | |
|---|---|---|---|
| 413522 | 2/1991 | European Pat. Off. . | |
| 1520858 | 8/1878 | United Kingdom | 209/588 |
| 2057123 | 3/1981 | United Kingdom | 209/587 |
| 2206213 | 12/1988 | United Kingdom | 209/588 |

*Primary Examiner*—Andres Kashnikow
*Assistant Examiner*—Christopher G. Trainor
*Attorney, Agent, or Firm*—Chernoff, Vilhauer, McClung & Stenzel

[57] ABSTRACT

A glass cullet separator utilizes a multi-element optical sensor to detect when an opaque particle in a group primarily composed of transparent particles moving along a plane passes a first line lying in that plane, and the particular location of the particle along the first line. A signal from the optical sensor is fed to a microprocessor. After a delay equal to the time it takes for a particle to pass between the first line and a second line, which is parallel to and separated from the first line, the microprocessor causes a valve to open and emit a jet of high velocity air from a nozzle aimed toward the plane along the second line. The jet of air blows the opaque particle out of the plane where it is captured and separated from the remainder of the particles. A plurality of nozzles are located in a manifold which extends across the extent of the second line. The manifold also supports the valves and fluid conduits that interconnect the valves and the nozzles.

13 Claims, 5 Drawing Sheets

GLASS CULLET SEPARATOR AND METHOD OF USING SAME

This is a continuation of copending application Ser. No. 07/798,166 filed on Nov. 26, 1991, now abandoned.

BACKGROUND AND SUMMARY OF THE INVENTION

This invention relates to a method and apparatus for removing foreign objects from glass, and for separating glass into clear and colored pieces prior to recycling.

When glass is collected for recycling, foreign material, such as rocks, sticks, ceramics and other material, needs to be separated from the glass or the recycled glass will be contaminated. In addition, clear glass and colored glass must be separated from one another prior to recycling. Heretofore, this removal of foreign material and separation has been done by hand which is time-consuming and expensive.

The subject invention overcomes the foregoing problem by providing an apparatus which passes the unsorted material in a discrete array along a defined plane. An optical sensing device senses when an opaque particle passes through a first line defined in the plane and where the particle is located along the first line. A series of nozzles, which emit a jet of high velocity fluid, are located adjacent to the plane with the nozzles arranged along a second line that is parallel to and offset from the first line in the direction the particles are moving. An actuator is activated by the sensing device to cause fluid to be emitted from one of the nozzles when an opaque particle sensed by the sensing device passes through the second line and blow that particle out of the plane. A chute located behind the plane captures the particles blown out of the plane and separates them from the remainder of the particles.

In a preferred embodiment of the invention, the optical sensor is a source of high intensity light that is located on one side of the plane, and a multi-element machine vision camera that is located on the other side of the plane. The machine vision camera has a plurality of light-sensitive diodes that are aimed toward the light. The diodes generate an electrical signal and the strength of the signal of each diode varies proportional to the intensity of the light that reaches the diode. The signal from the diode is fed through a microprocessor, which causes the fluid to be emitted from the proper nozzle at the proper time to blow the opaque particle sensed by the diode out of the plane.

In the preferred embodiment, each nozzle is supplied fluid through one or more electrically operated valves. After sensing a reduced signal from one of the diodes, the microprocessor waits a predetermined time so that the particle drops between the first line and the second line, and then opens the valve associated with the nozzle that is most closely aligned with that diode. The nozzles are carried in a manifold, which also carries the valves and the conduits that interconnect the valves with the nozzles. The manifold can either be formed from a solid block or from a series of single nozzle-containing elements which are bolted together.

An optical filter can be placed between the particles and the camera if it is desired to sort pieces of colored glass from clear glass. The colored glass can be separated by using a filter that absorbs the wavelength of light emitted through the colored glass so that the glass particles appear opaque to the camera.

Accordingly, it is a principal objective of the subject invention to provide an apparatus which optically senses and removes opaque particles from a group of primarily transparent particles.

It is a further object of the present invention to provide such an apparatus which utilizes by a machine vision camera and high intensity source of light which shines through the particles toward the camera to sense the opaque particles.

It is a still further object of the subject invention to provide such an apparatus which uses a jet of high velocity fluid to remove the opaque particles from the plane.

It is yet a further object of the subject invention to provide such an apparatus in which there are a plurality of nozzles through which the jet of fluid can be emitted.

It is a still further object of the subject invention to provide such an apparatus in which fluid is fed to the nozzles through remotely controlled valves.

It is a further object of the subject invention to provide such an apparatus in which a microprocessor is used to open the appropriate valve at the proper time upon receiving a signal from the camera, so that a jet of fluid strikes a particular particle sensed by the camera.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENT

Figure 1:
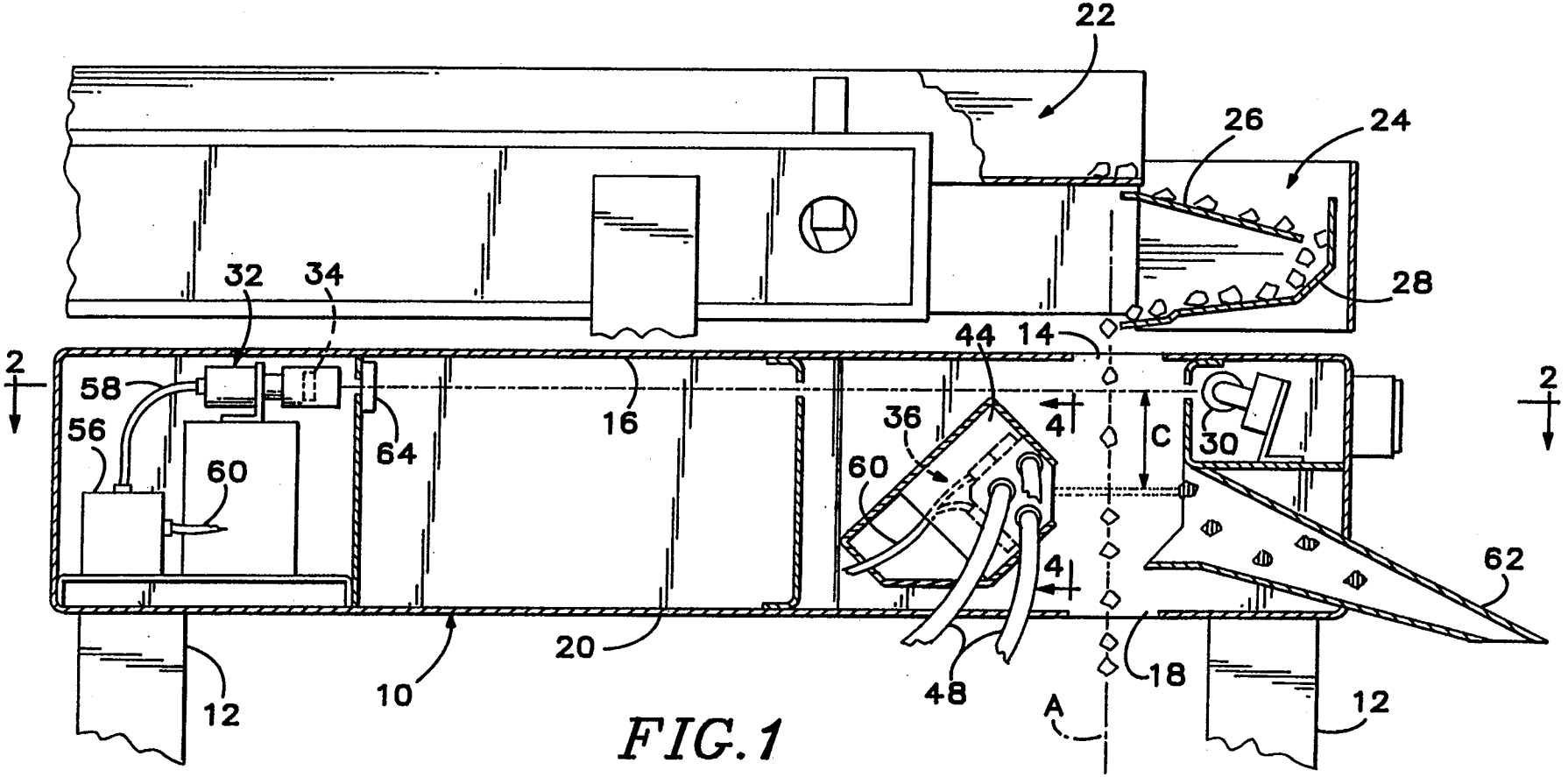
FIG. 1 is a foreshortened side elevation view, partially broken away to show hidden detail, of a glass cullet separator embodying the subject invention.
Figure 2:
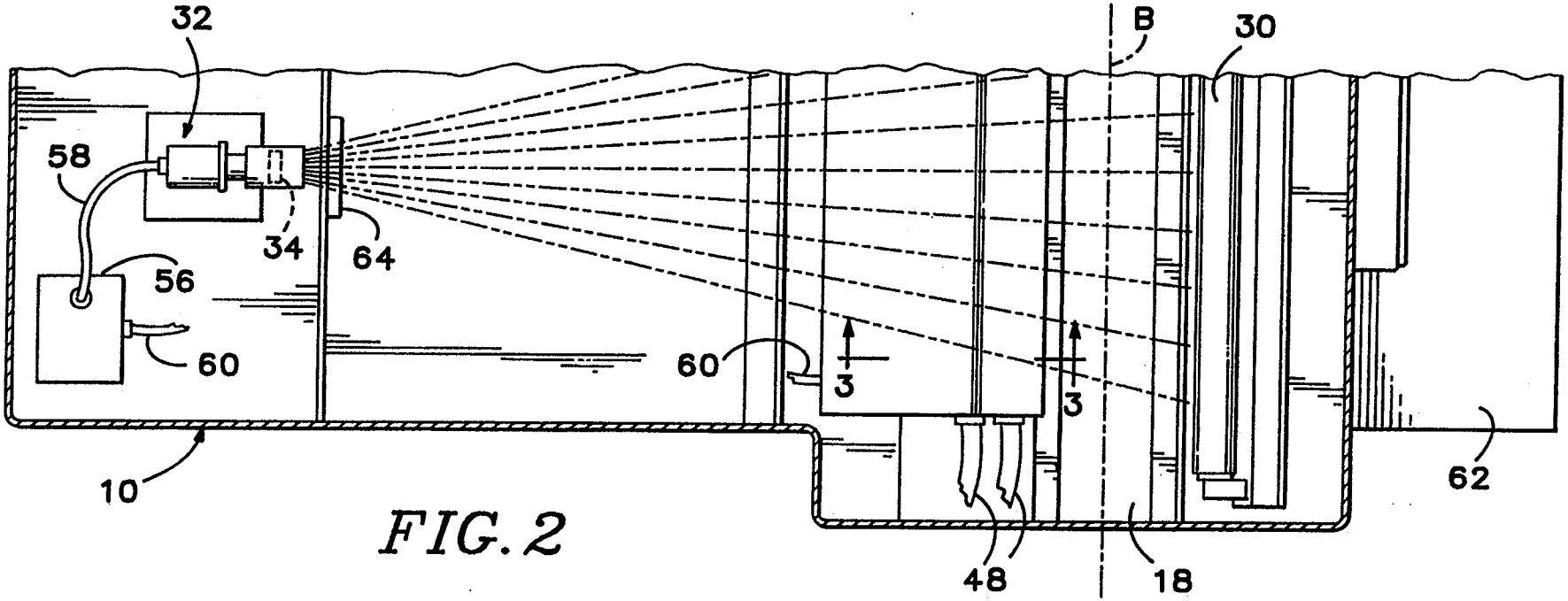
FIG. 2 is a fragmentary sectional view taken along the line 2—2 in FIG. 1.

Referring to FIGS. 1 and 2 of the drawings, a glass cullet separator embodying the subject invention comprises a rectangular shell 10 that is supported in an elevated position by legs 12. The shell has an in-feed slot 14 that extends across its upper skin 16, and a discharge slot 18 that extends across its lower skin 20 directly below the in-feed slot. Otherwise, the shell is completely enclosed.

Located above the shell is an oscillatory vibrating shaker table 22 into which the glass particles that are to be recycled are deposited. The shaker table, which is commercially available, processes material that is received in batches into a steady stream of individual particles with most of the particles being coplanar. However, because of its oscillatory nature, the particles discharged from the table often are not lying flat and a portion of the particles are not coplanar. In order to ensure that all of the particles are coplanar and are laying flat, the particles are passed across a series of inclined ramps 24. The ramps 24 are mechanically connected to the table 22 so that they move with the table. Their movement is not as pronounced as the table, however, and is mostly horizontal. Thus, the ramps spread the particles out so that they are completely coplanar and are flat. In the embodiment illustrated there is a first ramp 26, that receives particles from the table, and a second ramp 28, that receives particles from the first ramp and discharges them into the in-feed slot 14 of the shell 10. As a result of the separation caused by the ramps, the particles drop through the shell along a vertical plane A, and they are oriented with their smallest dimension perpendicular to that plane. The table and the ramps, and thus the plane A, have a width which is slightly less than the width of the shell 10. Located at the end of the shelf containing the slots 14 and 18 and proximate the upper skin 16 is a source of high intensity light 30 that extends across the entire width of the shell and is directed across the plane A. The light source preferably is a fluorescent tube of the type used in photocopy machines. Located at the other end of the shell, at the same level as the light 30, is a commercially available machine vision camera 32 that is aimed toward the light. The machine vision camera contains a plurality of light sensitive diodes 34 that can discern various degrees of brightness. A typical machine vision camera would have approximately 1,000 separate diodes and could sense over 250 degrees of brightness. The camera provides an output signal for each diode and the strength of each signal varies according to the degree of brightness of the light source sensed by that diode. Since the diodes 34 and light 30 are at the same vertical location, the light sensed by the diodes passes through the plane A along a horizontal line B that extends across the plane. Line B is termed the image line. As can be seen in FIG. 2, the image line is optically focused onto the diodes so that each diode senses light that passes through a unique point on the image line.

Figure 3:
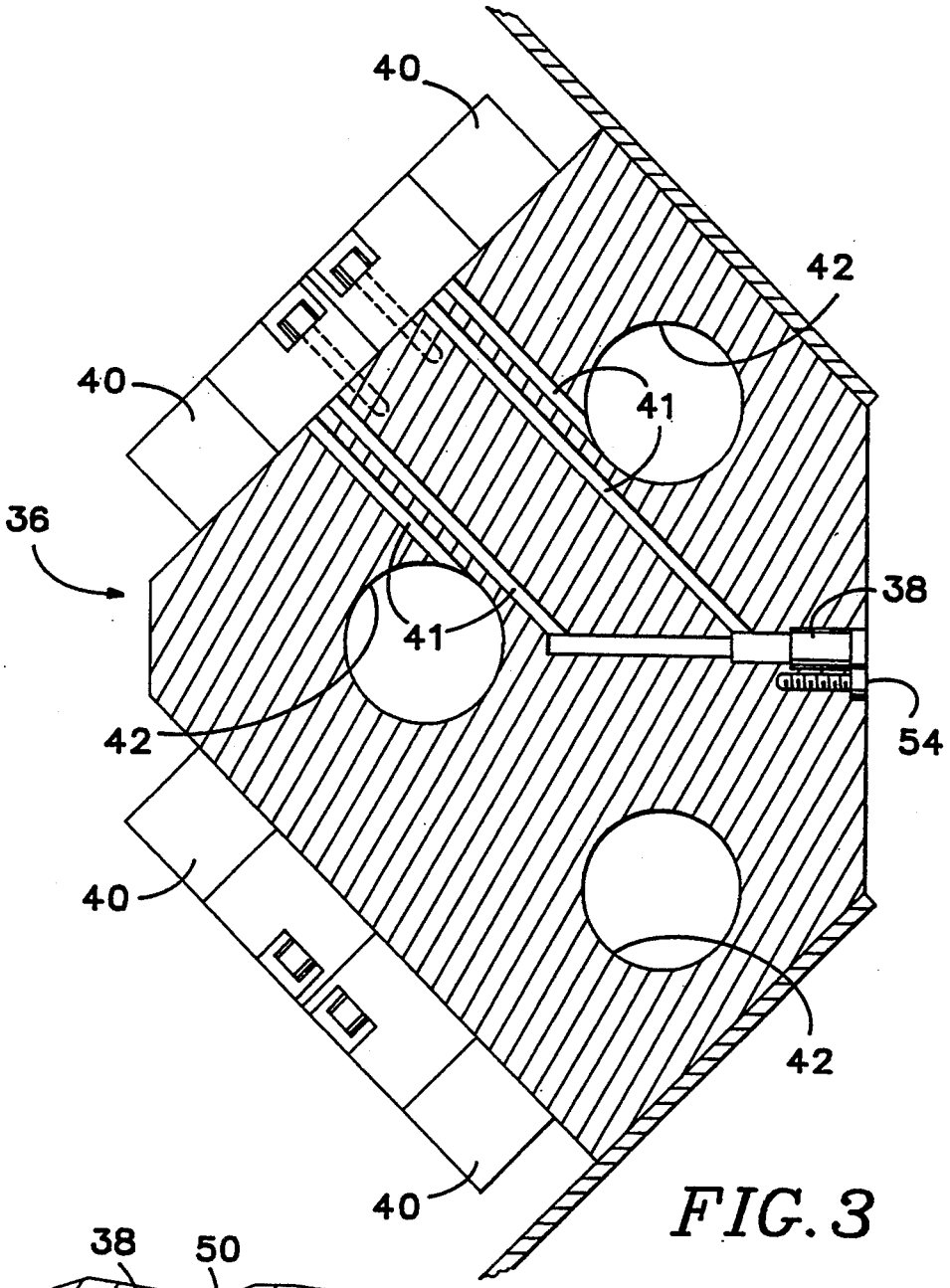
FIG. 3 is a sectional view, at an enlarged scale, taken along the line 3—3 of FIG. 1.
Figure 5:
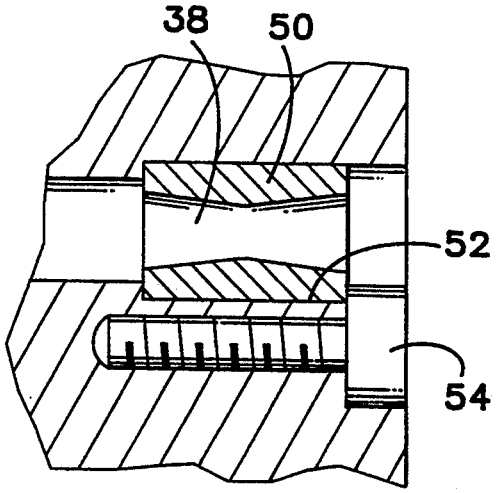
FIG. 5 is a detail view showing the nozzle assembly in the manifold.
Figure 4:
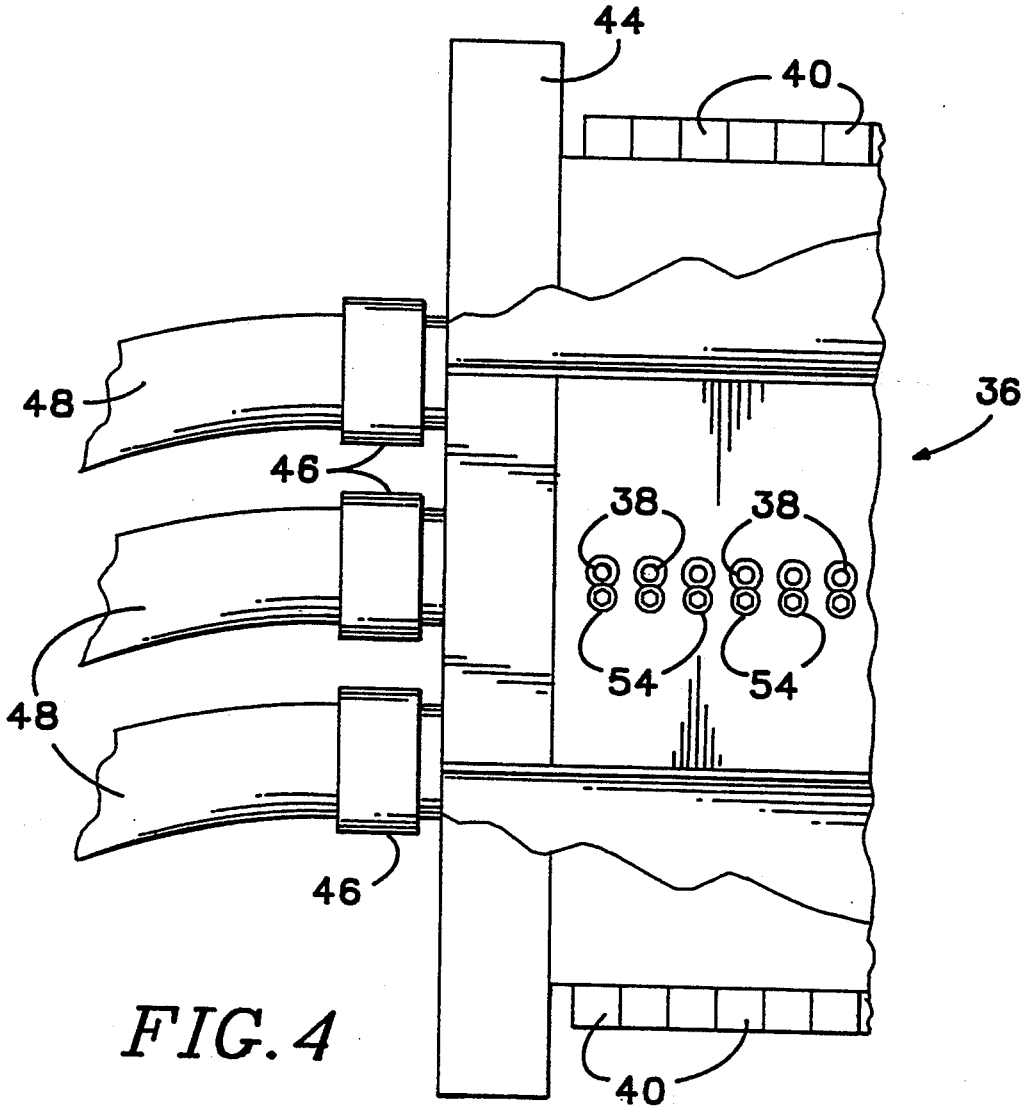
FIG. 4 is a fragmentary side elevation view, partially broken away to show hidden detail, of a portion of the manifold shown in FIG. 3.

Referring now also to FIGS. 3–5, located across the plane A from the light 30 is a manifold 36 that carries a plurality of the nozzles 38. The nozzles are arranged along a line that is parallel with the image line and are aimed in a direction that is perpendicular to plane A. The nozzles are located below the image line by a predetermined distance C. The manifold extends across the entire width of the plane A, and the nozzles are placed at evenly spaced intervals along the manifold. The number of nozzles, and thus the spacing between them, is limited only by the physical size of the nozzles, and the larger the number of nozzles the better control that can be obtained. While the drawings do not indicate the number of nozzles, manifolds have been tested that contain approximately 100 nozzles and they work well for the intended purpose.

The manifold illustrated in FIGS. 1–5 is an integrated manifold that is machined from a solid block of material. The manifold not only carries the nozzles 38 but also carries the valves 40 that regulate the flow of fluid through the nozzles and the fluid conduits 41 that interconnect the valves and the nozzles. In the embodiment illustrated, there are two valves 40 for each nozzle because there are no valves on the market that are small enough to fit in the limited space available and provide the response time and air flow requirements necessary for this apparatus.

Three large air passageways 42 extend through the entire extent of the manifold. The air passageways are covered at each end by removable plates 44. Fittings 46, that fit in openings in the plates 44 at one end of the manifold, open into the air passageways. Fluid from a source of pressurized fluid (not shown) is provided to the fittings through tubes 48. One of the outside passageways 42 feeds only the even numbered nozzles, and the other outside passageway feeds only the odd numbered nozzles. The center passageway feeds both nozzles. The conduits 41 interconnect the passageways 42 with the inlet ports (not shown) of the valves 40, and the outlet ports (not shown) of the valves with the nozzles.

In the embodiment illustrated the nozzles 38 are removable. As can be seen in FIG. 5, each nozzle is a cylindrical sleeve 50 that slidably fits in a conforming bore 52 located in the manifold. A bolt 54, threadedly engaged in a hole beside the bore 52, contacts the sleeve and holds it in place in the bore. A converging-diverging nozzle is used in order to permit supersonic flow when the fluid is air. Preferably, the pressure in the manifold is such (approximately 90 psig) that the air flow at the nozzle exit will be approximately mach 2.

The signals from the camera 32 are passed to a microprocessor, shown schematically at 56, through cables 58. The microprocessor in turn is connected to the valves through cables 60. The microprocessor is programmed to detect when the output of one of the diodes 34 drops below a certain value which would identify that an opaque particle has passed the image line B between the light source 14 and the particular diode. The microprocessor is programmed to delay a predetermined time, i.e., the time it takes for a particle to drop the distance C, and then open the valves that feed the nozzle that is aligned with that particular diode. After a predetermined dwell time the microprocessor causes the valves to close again. The dwell time is set to cause the jet to displace a particle from the plane A. A chute 62 mounted in the shell below the plane of the nozzles collects the particles displaced by the jets and directs them out of the apparatus to an appropriate collection device (not shown). The remainder of the particles drop out of the discharge slot 18 into a separate collection device for recycling.

The apparatus can also be used to separate colored glass from clear glass by placing an optical filter 64 between the plane A and the camera 32. A filter is selected that absorbs light having a wavelength associated with light passing through the particular color of glass that is to be removed. Thus, colored glass appears to the camera to be opaque and will be blown out of the plane.

Figure 6:
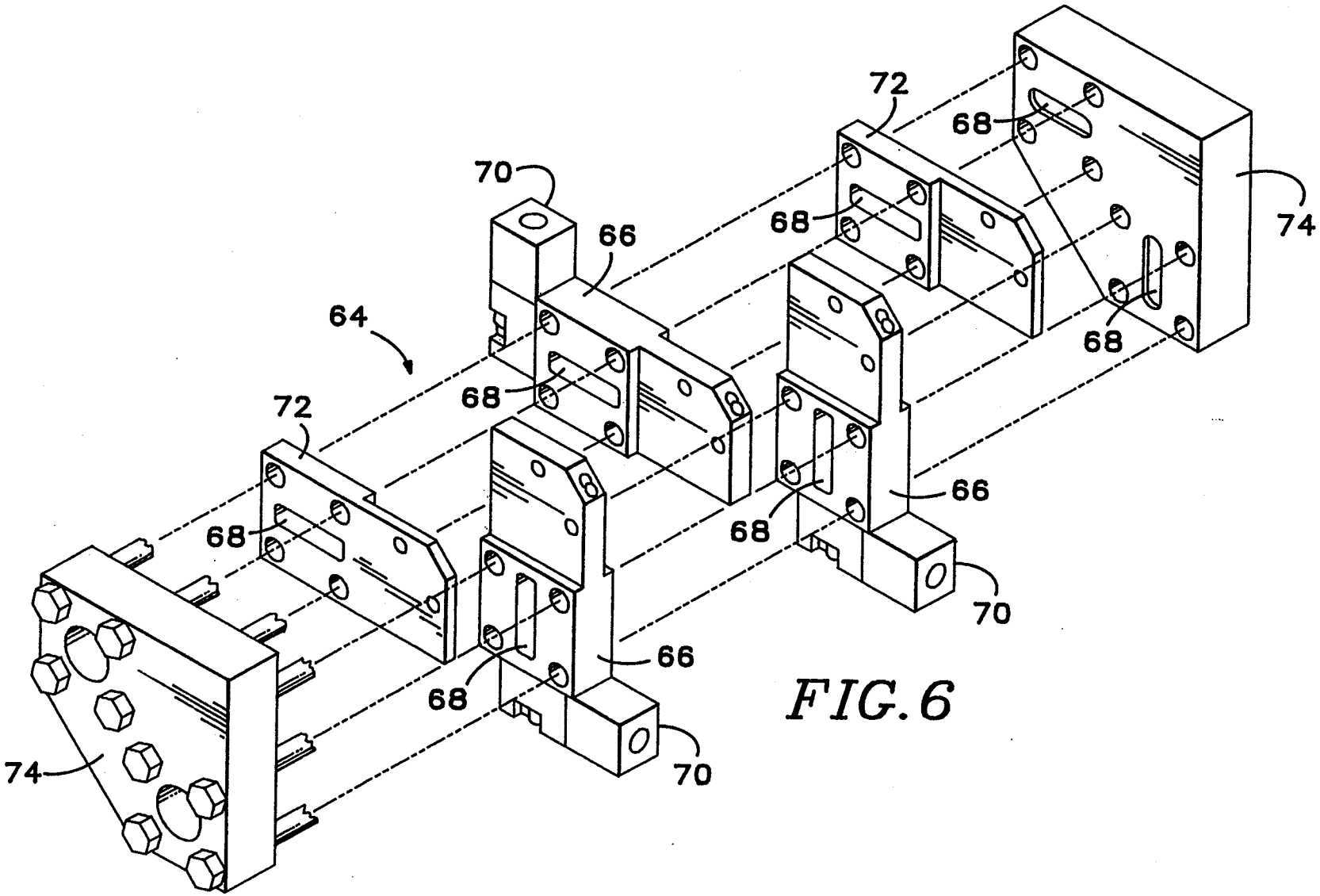
FIG. 6 is an exploded pictorial view of an alternate embodiment of the manifold.

In an alternate embodiment of the invention shown in FIG. 6, the manifold 64 is comprised of a plurality of separable segments 66, each of which carries a single nozzle. Thus, the number of nozzles can be changed by adding or subtracting the appropriate number of segments. Alternate segments are reversed end for end and rotated 90 degrees to provide separate passageways 68 for alternate nozzles, which is necessary to provide the required flow characteristics with available valves 70. Spacers 72 are provided at the outside ends of the segments in order to provide a flat outside face. End plates 74 cover each end of the assembly, and bolts 76 extend through the assembly to hold it together as an integral unit. This embodiment not only allows varying the number of nozzles, but does not require as difficult machining as is required in an integral manifold.

With either manifold operation of the device is straightforward. Glass cullet, including foreign material that is to be sorted out, is deposited into the shaker table 22 which spreads the material out and deposits it on the inclined ramps 24. The ramps further spread the material and cause it to lay flat, so that when the material drops from the discharge end of the second ramp 28 it falls through the shell 10 along the vertical plane A in a discrete array with the smallest axis of each particle oriented perpendicular to the plane.

As the particles pass the line B any opaque particle blocks a localized portion of the light from the light source 30 and the diode 34 that is aligned with that opaque particle senses the lower light level and its output signal is reduced. The microprocessor 56 senses this reduced signal, creates a time delay equal to the time it takes for the particle to drop the distance C, and then opens the valve 40 that is aligned with that particular diode. A jet of high velocity air is ejected from the nozzle and the opaque particle is blown out of the plane A and into the chute 62 where it is collected. The remaining transparent particles drop out of the shell through the discharge slot 18 where they are collected separately from the opaque particles.

If the cullet contains semi-transparent colored glass the collected particles must then be passed through the device again with the correct filter in place to cause the diode to sense colored pieces as opaque and remove them.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A manifold (36) for delivering air to a plurality of nozzles (38) for delivering high pressure, high volume blasts of air into a stream of particles for the purpose of displacing particular particles from the stream of particles as part of a system for removing nonconforming particles, said manifold comprising:

(a) an elongate member having a plurality of passageways (42) extending longitudinally therethrough, said member having a nozzle surface and at least one valve surface;

(b) said member defining a plurality of bores (52), each of said bore receiving therein one of said nozzles (38) which opens out of said nozzle surface;

(c) said member defining a plurality of air conduits (41) for conducting the flow of air;

(d) a first plurality of valve pairs (40) aligned substantially longitudinally on a first valve surface of said at least one valve surface of said member and a second plurality of valve pairs (40) aligned substantially longitudinally on a second valve surface of said at least one valve surface of said member, said valves for regulating airflow between said air passageways and said bores;

(e) whereby for each said bore;

(i) a first one of said air conduits extends between said bore and one of said valve surfaces so as to have fluid communication between said bore and a first valve of one of said valve paris;

(ii) a second one of said air conduits extends between said first valve and a first one of said air passageways;

(iii) a third one of said air conduits extends between said bore and said one of said valve surfaces so as to have fluid communication between said bore and a second valve of said one of said valve pairs; and (iv) a fourth one of said conduits extends between said second valve and a second one of said air passageways.

2. The manifold of claim 1 wherein said plurality of nozzles are converging-diverging nozzles for promoting supersonic air flow.

3. The manifold of claim 1 wherein said elongate member has a hexagonal cross-section and six longitudinally extending sides and two end faces wherein one side defines said nozzle surface, one side defines said first valve surface, and one side defines said second valve surface.

4. The manifold of claim 3 wherein said nozzle surface is not coterminous with either said first valve surface or said second valve surface, and said first valve surface is not coterminous with said second valve surface.

5. The manifold of claim 1 wherein said plurality of air passageways comprise said first air passageway, second air passageway, and a third air passageway, all of said passageways extending longitudinally through said member.

6. The manifold of claim 5 wherein a first set of bores of said plurality of bores, comprising every other bore, are in selective fluid communication with said first air passageway and said second air passageway and a second set of bores of said plurality of bores, comprising bores alternate with said first set of bores are in selective fluid communication with said first air passageway and said third air passageway.

7. The manifold of claim 6 wherein said selective fluid communication of said first set of bores and said first air passageway is controlled by one valve of one said valve pair of said first plurality of valve pairs and said selective fluid communication of said first set of bores and said second air passageway is controlled by the other valve of one said valve pair of said first plurality of valve pairs.

8. The manifold of claim 6 wherein said selective fluid communication of said second set of bores and said first air passageway is controlled by one valve of one said valve pair of said second plurality of valve pairs and said selective fluid communication of said second set of bores and said third air passageway is controlled by the other valve of one said valve pair of said second plurality of valve pairs.

9. A manifold (36) for delivering air to a plurality of nozzles (38) for delivering high pressure, high volume blasts of air into a stream of particles for the purpose of displacing particular particles from the stream of particles as part of a system for removing nonconforming particles, said manifold comprising:

(a) an elongate member defining a first air passageway (42), a second air passageway (42), and a third air passageway (42), all said passageways extending longitudinally through said member, said member having a hexagonal cross-section and six longitudinally extending sides wherein one of said sides is a nozzle side one of said sides is a first valve side, and one of said sides is a second valve side;

(b) said member defining a plurality of bores which open into said nozzle side, a first plurality of air conduits which open into said first valve side, and a second plurality of air conduits which open into said second valve side; and (c) a first plurality of valve pairs (40) aligned substantially longitudinally on said first valve side and a second plurality of valve pairs (40) aligned substantially longitudinally on said second valve side, said valves for regulating airflow between said air passageways and said bores through said conduits, whereby a first set of alternate bores of said plurality of bores is in selective fluid communication with said first passageway and said second passageway and a second set of alternate bores of said plurality of bores in selective fluid communication with said first passageway and said third passageway.

10. The manifold of claim 9 wherein said selective fluid communication between each said bore in said first set of alternate bores and said first passageway comprises a first one of said first plurality of air conduits that extends between said bore and one valve of said valve pair on said first valve side and a second one of said first plurality of air conduits that extends between said one valve of one said valve pair on said first valve side and said first passageway.

11. The manifold of claim 10 wherein said selective fluid communication between each bore in said first set of alternate bores and said second passageway comprises a third one of said first plurality of air conduits that extends between said bore and another valve of said one valve pair on said first valve side and a fourth one of said first plurality of air conduits that extends between said another valve of one said valve pair on said first valve side and said second passageway.

12. The manifold of claim 9 wherein said selective fluid communication between each said bore in said second set of alternate bores and said first passageway comprises a first one of said second plurality of air conduits that extends between said bore and one valve of one said valve pair on said second valve side and a second one of said second plurality of air conduits that extends between said one valve of one said valve pair on said second valve side and said first passageway.

13. The manifold of claim 12 wherein said selective fluid communication between each said bore in said second set of alternate bores and said third passageway comprises a third one of said second plurality of air conduits that extends between said bore and another valve of one said valve pair on said second valve side and a fourth one of said second plurality of air conduits that extends between said another valve of one said valve pair on said second valve side and said third passageway.

* * * * *

UNITED STATES PATENT AND TRADEMARK OFFICE

CERTIFICATE OF CORRECTION

PATENT NO. : 5,350,118

DATED : September 27, 1994

INVENTOR(S) : James T. Mitchell, et al.

It is certified that error appears in the above-indentified patent and that said Letters Patent is hereby corrected as shown below:

Col. 5, Line 62: delete "paris" insert -- pairs --

Col. 8, Lines 1-2: delete "said one" insert -- one said --

Signed and Sealed this

Third Day of January, 1995

*Attest:*

*Attesting Officer*

BRUCE LEHMAN

*Commissioner of Patents and Trademarks*